United States Patent [19]

Bolles et al.

[11] 3,937,970

[45] Feb. 10, 1976

[54] OPTICALLY-TRANSPARENT RADIATION-SHIELDING COMPOSITION

[75] Inventors: Theodore F. Bolles; Peter B. Fleming, both of Woodbury, Minn.

[73] Assignees: Theodore F. Bolles; Peter B. Fleming, both of St. Paul, Minn.

[22] Filed: May 16, 1974

[21] Appl. No.: 470,351

[52] U.S. Cl. ..... 250/515; 250/510; 250/520; 252/300

[51] Int. Cl.[2] ..... G21C 11/00

[58] Field of Search ..... 252/478, 300; 250/515, 250/520, 482, 505, 515, 516, 519, 520

[56] References Cited

UNITED STATES PATENTS 2,403,794 7/1946 Goldrick ..... 250/515

2,439,374 4/1948 Leader ..... 252/478

*Primary Examiner*—Harold A. Dixon

*Attorney, Agent, or Firm*—Alexander, Sell, Steldt & Delahunt

[57] ABSTRACT

An optically transparent, essentially colorless radiation shielding material for high energy radiation contains a combination of lead or thallium salts of $C_1$ to $C_5$ organic acids and may contain lead or thallium salts of mineral acids. Shields of complex shapes are easily constructed.

10 Claims, 3 Drawing Figures

OPTICALLY-TRANSPARENT RADIATION-SHIELDING COMPOSITION

This invention relates to optically transparent radiation shielding devices and compositions for use therein.

Heretofore, personnel have been shielded from high energy radiation, such as X-rays, or gamma rays, by use of lead or lead-concrete barriers. When it is necessary for the personnel to observe operations, lead-borosilicate glass, plastics loaded with metal salts, or solutions containing a high concentration of heavy metal salts are utilized as optically transparent radiation shields. The prior art is represented, for example, in U.S. Pat. Nos. 2,162,178; 2,403,794; 2,441,945; 2,683,650; 2,748,099; 3,148,160; 3,149,235 and 3,286,095 095 and in publications such as Bartholomew and Lewck, Journal of the American Ceramic Society, Vol. 53, pages 445–7, Van Uitert, Bonner and Grodkiewicz, Materials Research Bulletin, Vol. 6, pages 513–8 (1971).

Heavy metal atoms such as lead, are capable of absorbing high energy radiation, and the effectiveness of the shield is a function of the heavy metal concentration. Thus, in providing a shield for high energy radiation, the required thickness of the shield is a function of the concentration of the heavy metal and the energy of the radiation to be absorbed. Specifically, if the energy of the $\gamma$-rays or X-rays is relatively low, either a very thin shield containing a high concentration of heavy metal or a thicker shield containing a lower concentration of metal may be utilized. Thus, high energy radiation either requires a low concentration of heavy metal in a very thick shield, which tends to reduce the optical transparency of the shield or a high concentration of heavy metal in the shielding material which permits a thinner shield but also tends to reduce the optical transparency.

The lead glass radiation shields are optically transparent, but are brittle, expensive and are often more or less yellow colored particularly at very high lead contents. Complex shapes must be formed at the high temperatures of molten glass. Furthermore, the glasses are soft and relatively easily scratched and must be polished and may even have to be immersed in oil.

Polymers loaded with metal are not transparent; and polymers loaded with metal salts necessarily contain a lower concentration of metal if the shield is to be transparent.

The use of solutions in glass presents the danger of a cracked glass, loss of solution and subsequent loss of radiation shielding. Because solubility limits the concentration of the metal, shields incorporating solutions have to be inordinately thick in order to shield against high energy radiation and therefore require very clear solutions. Although a solution of lead perchlorate is a relatively good absorber for radiation, the crystallization of small quantities of the salt as a result of evaporation may create the risk of an explosion.

It is an object of this invention to provide a high energy radiation shield which is optically highly transparent but capable of being formed in any convenient configuration. It is a further object to provide a high energy radiation shield which is relatively inexpensive. Other objects will become apparent herein elsewhere.

In accordance with these and other objects of the invention, it has been found that a relatively inexpensive high energy radiation shield is produced by filling a suitable container means with a highly viscous, substantially optically transparent, clear and colorless metastable liquid or fused composition comprising at least one lead salt of $C_1$ to $C_5$ organic acids, and at least one chloride, bromide, nitrate or different salt of organic acid of one to five carbon atoms of at least one metal of the group consisting of lead, thallium and mercury. In general, such compositions are nearly anhydrous but they may retain small amounts of water particularly when one or more of the salts form hydrates.

Referring to the drawings herewith,

Figure 1:
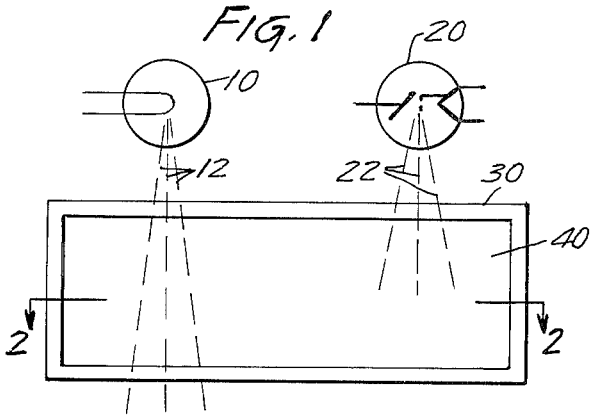
FIG. 1 shows a top view of a high energy radiation shield of the invention.
Figure 2:
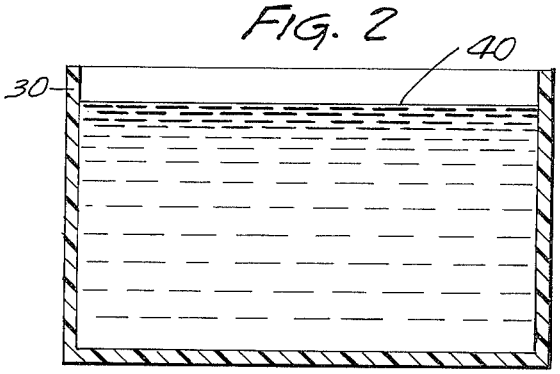
FIG. 2 shows a cross-section at 2—2 of the high energy radiation shield of FIG. 1.

In FIG. 1 it will be seen that container means 30 containing transparent, clear and colorless metastable liquid composition 40 is illumed by incandescent light source 10 the rays of which 12 pass through container means 30 and composition 40 whereas the high energy source 20 produces rays 22 which are absorbed as they pass through composition 40. From FIG. 2 it is evident that container means 30 is constructed of plastic and that the contents 40 are a liquid.

Figure 3:
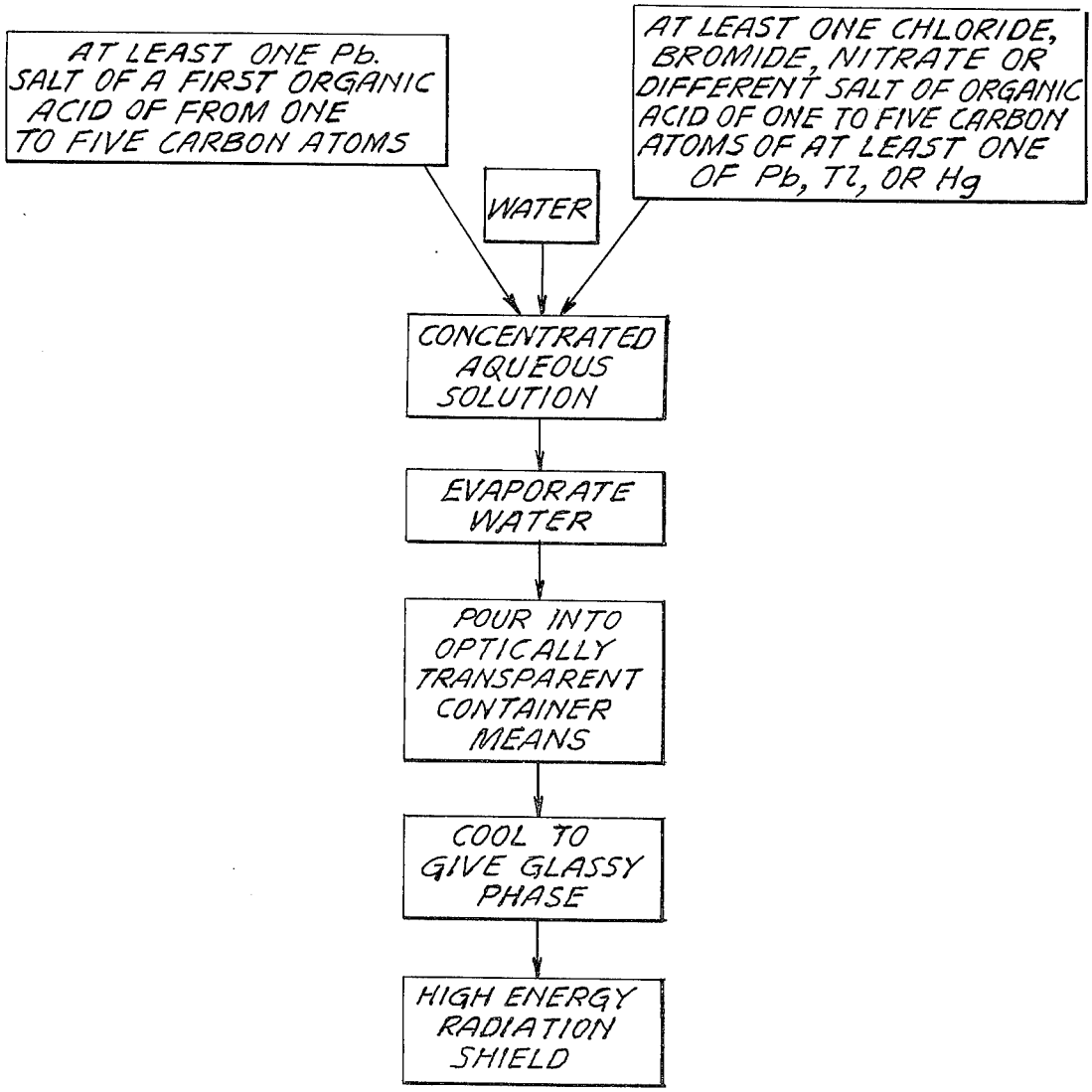
FIG. 3 is a flow diagram showing the method of making a high energy radiation shield according to the invention.

In the flow diagram of FIG. 3 it will be seen that water is combined with at least one lead salt of a first organic acid of from 1 to 5 carbon atoms and at least one chloride, bromide, nitrate or different salt of organic acid of 1 to 5 carbon atoms of at least one of lead, thallium or mercury to provide a concentrated aqueous solution from which water is evaporated to liquid so that on cooling the material will form a glassy phase, the liquid is poured into optically transparent container means, the whole is cooled so that the glassy phase is obtained and there is thus obtained a high energy radiation shield.

The composition utilized in the radiation shield of this invention contains at least one lead salt of $C_1$ to $C_5$ organic acids, among such salts are included the anhydrous or hydrated salts:

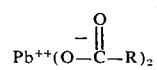

where

R is $C_nH_{2n-1}$ wherein $n$ is 0 to 4, or $C_xH_{2x-1}$ , wherein $x$ is 2,3 or 4 or $CH_{3-m}X_m$ wherein X is F, Cl, Br, I and $m$ is 1,2 or 3;

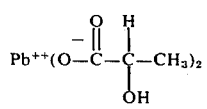

(lead(II)lactate) or

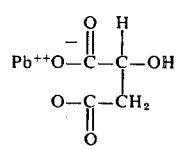

(lead(II)malate).

Lead mercury and/or thallium salts of inorganic mineral acids are also included in amounts up to about 35%, such as lead(II)nitrate, lead(II)chloride, lead(II)-bromide, lead(II)dithionate or lead(II)perfluoromethane sulfonate, and thallium salts of formic, acetic, propionic, butyric, nitric or dithionic acid. The inorganic acids which can be employed are generally those which form lead salts having a solubility of at least about 1% in water at 100° C. The composition must have two or more components and may include minor amounts of other materials which are soluble in it at the melting point such as lead oxide or mercuric acetate or nitrate.

The selection of salts for use in the composition is based upon the energy of the radiation and the desired thickness and use of the shield. If a thin shield is desired and the energy of radiation is high, lead acetate and propionate are preferred because these salts possess higher concentrations of lead. If, however, the physical dimensions of the shield are not critical, then a combination of larger anions can be tolerated.

Not only are the density and concentration of lead determined by the ratio of salts, but the clarity of the resultant metastable solid or highly viscous liquid is also determined by the ratio of the salts. For example, 75% lead acetate and 25% lead propionate gives a solid which maintains its optical transparency for many months. If the concentration of lead acetate is changed to 80% and if the lead propionate is 20%, crystals form in the optically transparent solid in about one month. However, this 4:1 ratio of lead acetate to lead propionate may be utilized if a third component, such as lead butyrate is added in amounts of a few percent of the total.

The lead salts utilized in this invention may be purchased as such or prepared by reacting lead(II) oxide, lead carbonate, basic lead carbonate or similar basic lead salts with the appropriate organic or mineral acid in water. This solution is heated until substantially all of basic lead salt is dissolved, filtered hot and the filtrate is evaporated until a concentrated anhydrous salt solution remains from which lead salts crystallize on cooling. The crystalline mass is broken up and washed with acetone to remove the residual water and organic acid. The salt obtained after washing is a white, free-flowing crystalline lead acetate, propionate, butyrate, valerate or other salt depending on the acid used.

Thallium(I) salts are prepared in similar manner by reacting thallium(I) carbonate with the appropriate organic or mineral acid.

The composition used in the invention is made by mixing together two or more salts in the appropriate concentration. One lead salt of an organic acid must be used, and additional components may be lead thallium and/or mercury organic and/or inorganic salts which serve to reduce the melting point into a suitable range. The mixture is heated to form a clear, essentially water white, moderately viscous liquid. Temperatures are usually of the order of 100° – 120° C or broadly from about 75° – 150° C. Some decomposition may occur at higher temperatures. Nitrogen or other inert gases may be bubbled through the heated liquid to remove entrapped gases and water. Alternatively, entrapped gases and water may be removed by evaporation in a vacuum oven. The clear, viscous, essentially colorless hot liquid is then poured into a clear plastic or glass shield casing, or similar optically transparent container means, and allowed to cool to room temperature. The mixture, upon cooling, may contract somewhat and the case or container may be filled by adding additional hot or warm liquid. Upon cooling, the liquid solidifies to form an optically transparent, substantially colorless, noncrystalline solid mass. Although the mass is hard and may be referred to as being solid, it is in a metastable state as a very viscous glass fluid or liquid and may flow somewhat over prolonged times. Therefore, the optically transparent container means, such as a plastic mold or shell, is an integral part of the radiation shield.

The container means may be of an extremely complicated design or shape because it is only limited by the ability to form the plastic or glass used. Particular shapes will be made for particular purposes. In a preferred form the container means is made of an optically transparent plastic which is stable up to 110° C such as polymethylmethacrylate or polycarbonate. Polystyrene or glass may also be used. In filling a container means of a relatively low melting polymer, the container means may be cooled externally during filling. In some instances when the composition of lead salts is sufficiently stable and rigid, a coating of polyvinylacetate may be applied to the surface and serve as container means.

The thickness of the radiation-absorbent material and the concentration needed in the shield are determined by consideration of the energy and type of radiation emitted by the isotope to be shielded. If, for example, $Tc^{99m}$ is to be considered, then the thickness of the shield required will be a function of the heavy metal concentration. The symbol will be recognized as referring to a 140 Kev $\gamma$-emitter which yields $Tc^{99}$.

The density of lead(II)acetate hemihydrate-lead(II) propionate compositions varies from about 2.33 g/cc at 100% of the propionate to about 3.34 g/cc at 100% of the acetate. From these data, one can calculate the variations in $d_{1/2}$ in cm. for $Tc^{99m}$ over this range of compositions which decreases from about 0.21 cm. to 0.14 cm. The symbol $d_{1/2}$ is used to represent the thickness in centimeters which results in absorption of ½ the incident radiation i.e., to reduce 100 gamma counts per minute to 50 counts per minute.

EXAMPLE 1

A litharge (PbO) suspension in water is dissolved in an equimolar mixture of propionic, acrylic, n-butyric and isobutyric acids. Evaporation of the water from the solution at 80° C gave a clear, colorless rather viscous liquid with a density of 2.5 gm/cc. Because the lead content of an equimolar mixture of lead(II)acetate, lead(II)acrylate, lead(II)n-butyrate and lead(II)isobutyrate is approximately 56%, the product contains about 1.5 gms Pb/cc.

The material is fabricated into a radiation shield by heating the composition to 100° C and pouring the mixture into an appropriate container means to give 1 cm. thickness. Upon cooling to room temperature, the composition becomes tough, hard, clear and colorless.

The fabricated shield reduced the observed 140 Kev $\gamma$-radiation from Technetium - 99m from 23,000 counts/minute to about 200 counts/minute as determined by use of a Geiger counter.

EXAMPLE 2

Preparation of lead(II)propionate

Lead(II)oxide (2.86 kg - 12.8 moles) is added over a one hour period to a heated solution of propionic acid (2.00 kg - 27.0 moles) in 1.5 liters water. The solution is heated near the boiling point and stirred until substantially all of the lead oxide has dissolved and the solution is transparent with a small amount of red solid suspended therein. The hot solution is filtered through a medium glass frit and the filtrate concentrated by evaporation of about half the water, suitably in an oven held at 100° C under a slow air stream. The clear, liquid concentrate is allowed to cool to room temperature and crystallizes. The cake of crystals is broken up and washed with large amounts of acetone to remove residual acid and water and finally washed with acetone and ether on a Buechner funnel. The resulting lead propionate is a white, free flowing powder, m.p. 120° C., % Pb in $Pb(C_3H_5O_2)_2$: Calculated at −58.7; found 58.7, 58.6.

Preparation of lead(II)butyrate

Lead(II)oxide (1.59 kg - 7.13 moles) is slowly added over a 1 hour period to a heated mixture of butyric acid (2.00 kg - 22.8 moles) in 15 liters distilled water. The reactants are stirred and heated. Phase separation, which may occur, is eliminated by addition of ethanol or methanol. The warm, clear solution containing a small amount of unreacted red solid is filtered on a medium frit and the bulk of the solvent removed in a vacuum oven at 60° C. After cooling to room temperature, a solid crystal cake forms, which is broken up and washed on a suction filter with large amounts of acetone. The cake dries to a free flowing white crystalline powder, m.p. 70° C. Calculated for $Pb(C_4H_7O_2)_2$: 54.3 % Pb Found 54.5% Pb.

A radiation-absorbing, optically transparent, colorless composition is prepared using the above prepared salts by mixing together 1.5 kg. reagent grade lead(II)acetate trihydrate, 1.5 kg. lead(II)propionate and 1.5 kg. lead(II)butyrate in a large glass breaker or stainless steel container. The beaker or container and its contents are heated and maintained at 120° C in an oil bath. The compounds readily melt together to form a clear, moderately viscous liquid. There is some effervescence during early stages of heating due to the release of water from the lead(II)acetate. Nitrogen gas is bubbled through the mixture to provide stirring and to sweep out entrapped gases and water. After three hours purging with nitrogen and maintaining the temperature at 120° C, the mixture is quite viscous. The mixture is allowed to cool to 100° C and poured into a casing made of 3 mm. thick polymethylmethacrylate. The casing was 15 × 22.5 × 2.5 cm. The entire assembly is allowed to cool to room temperature, and an additional small amount of the liquid lead salt mixture is added to fill the container to the top. Then, a lid is affixed to the container to provide a hermetically sealed shield. The final composition in the shield contains 58.3% Pb and the density is 2.5 gm/cc and $d_{1/2}$ = 0.203 cm. Such a radiation shield of 1 inch thickness is equal to about twelve half-thicknesses for $Tc^{99m}$ 140 Kev γ-rays.

EXAMPLE 3

An aqueous suspension is made from 446 g. lead oxide (PbO) in 800 ml. distilled water by stirring rapidly and a mixture of 180 gm. glacial acetic acid and 74 gm. propionic acid is added to the suspension over 1 hour to dissolve the lead oxide. After the reaction is substantially complete, the solution is filtered and the filtrate is heated at 80° C in vacuo to evaporate the water. The resultant clear, colorless, viscous liquid was heated to 100° C and poured between two concentric cylinders of polymethylmethacrylate with one end sealed at the bottom designed as a shielding vial container. The annular space between the cylinders is 1 cm. A reagent vial containing radioactive material could be placed inside this radiation absorbing shield for storage. Suitable shields might also be placed at the ends.

The composition assayed 61.4% Pb and had a density of 2.7 gm/cc, $d_{1/2}$ (for 140 Kev γ) = 0.178 cm.

EXAMPLE 4

Lead(II)lactate, lead(II)crotonate and lead(II)valerate are prepared by essentially the procedures above by reacting basic lead carbonate with the acid in water. The water is substantially removed by evaporation and the residue is then allowed to crystallize and is treated with acetone to remove the remainder of the water. The fine crystalline colorless salts are vacuum dried.

Two methods of preparing radiation shields are convenient.

Method A.

Pure components (lead or thallium salts) are mixed together and heated to about 120° C to form a clear, colorless, viscous liquid. The liquid is heated at 120° C until the extraneous water is substantially removed, as indicated by cessation of bubbling, and nitrogen is then bubbled through the hot liquid mixture for about ½ hour to remove extraneous gases. A portion of the mixture is poured into a vial as a sample and the vial is capped. Another portion is poured into a 19 × 9.4 × 1.4 cm. shield casing made of 3 mm. polymethylmethacrylate.

Method B.

Pure components are mixed together and heated to about 120° C, and a small amount of water is added to hasten the formation of a clear liquid. The clear compositions are heated to 130° for approximately 30 minutes and are then swept with a stream of dry nitrogen for about 15 minutes. Substantially all water (except possibly ½ mole associated with lead(II)acetate) is removed and the resulting clear, colorless, viscous liquid is treated as in Method A.

Various mixtures of salts are used in Examples 5 through 13 as shown in Table I. The salts are given in parts per hundred. The density of each clear solid mixture is determined by the displacement method. The grams of metal per cc are calculated using the density and per cent metal in the mixture. Half thickness for $Tc^{99m}$ are determined using the graph on Page 114 of Friedlander, Kennedy and Miller, "Nuclear and Radiochemistry" 2nd Ed., John Wiley and Sons, Inc., New York (1964).

TABLE I

| EXAMPLE | METHOD | RADIATION SHIELD COMPOSITIONS INITIAL COMPOSITION | | | | | |
|---|---|---|---|---|---|---|---|
| | | Lead(II)acetate hemihydrate | Lead(II) propionate | Lead(II)n-butyrate | Lead(II)n-valerate | Lead(II) crotonate | Lead(II) lactate |
| 5 | B | 51.0 | 39.3 | — | — | — | — |
| 6 | B | 51.0 | 19.6 | — | — | — | — |
| 7 | B | 56.0 | 34.2 | — | — | — | — |
| 8 | B | 33.8 | 33.1 | — | — | — | — |
| 9 | A | 25.6 | 24.8 | 24.8 | 24.8 | — | — |
| 10 | A | 45.0 | 45.0 | — | — | 10.0 | — |
| 11 | A | 45.0 | 45.0 | — | — | — | 10.0 |
| 12 | A | 30.7 | 39.6 | — | — | — | — |
| 13 | A | 81.5 | — | — | — | — | — |

| EXAMPLE | METHOD | FINAL COMPOSITION | | | | | | |
|---|---|---|---|---|---|---|---|---|
| | | Lead(II) chloride | Lead(II) nitrate | Thallium(I) acetate | % Metal | Density: g/cc. | Concentration g. metal per cc. | $d_{1/2}$ for $Tc^{99m}$ (cm.) |
| 5 | B | 9.8 | — | — | 62.0 | 3.14 | 1.95 | 0.152 |
| 6 | B | 9.8 | 19.6 | — | 62.8 | 3.53 | 2.22 | 0.133 |
| 7 | B | — | 9.8 | — | 61.0 | 2.94 | 1.79 | 0.165 |
| 8 | B | — | 33.1 | — | 61.2 | 3.24 | 1.98 | 0.149 |
| 9 | A | — | — | — | 56.5 | 2.30 | 1.30 | 0.228 |
| 10 | A | — | — | — | 59.8 | 2.70 | 1.61 | 0.183 |
| 11 | A | — | — | — | 59.8 | 2.70 | 1.61 | 0.183 |
| 12 | A | — | — | 29.7 | 70.3 | 3.03 | 2.13 | 0.139 |
| 13 | A | — | 18.5 | — | 62.1 | 3.46 | 2.15 | — |

EXAMPLE 14

A fused mixture (after drying containing about 71:$Pb(C_2H_3O_2)_2 \cdot 0.5H_2O$ and 20% $Pb(C_3H_5O_2)_2$) is found to dissolve at 110° C at least 5% mercuric nitrate or up to at least 11% mercuric acetate. The same mixture readily dissolves about 3 – 4% of PbO by heating together for about 16 hours. On the other hand, bismuth nitrate tungstic oxide or tungstic acid do not appear to dissolve. The glassy solutions of salts made above also exhibit good radiation-shielding abilities.

What is claimed is:

1. A high energy radiation shield consisting essentially of

A. an optically transparent container means and, filling said container means,

B. highly viscous substantially optically transparent, coloress and clear liquid composition in metastable glassy state consisting essentially of a. at least one lead salt of a first organic acid of from one to five carbon atoms and b. at least one chloride, bromide, nitrate or different salt of organic acid of one to five carbon atoms, of at least one metal of the group consisting of lead, thallium and mercury.

2. A high energy radiation shield according to claim 1 wherein the colorless and clear liquid composition is substantially anhydrous.

3. A high energy radiation shield according to claim 1 comprising lead acetate.

4. A high energy radiation shield according to claim 2 comprising lead propionate.

5. A high energy radiation shield according to claim 2 comprising lead butyrate or valerate.

6. A high energy radiation shield according to claim 2 comprising lead(II)nitrate.

7. A high energy radiation shield according to claim 2 comprising thallium acetate.

8. A high energy radiation shield according to claim 1 comprising at least lead acetate and lead propionate together with two other lead salts of the group of butyrate, valerate, lactate, crotonate, chloride or nitrate.

9. A high energy radiation shield according to claim 1 comprising mercuric acetate.

10. The process for preparation of a high energy radiation shield which comprises the step of preparing a highly viscous substantially anhydrous optically transparent colorless and clear liquid composition in metastable glassy state by removing water from a concentrated aqueous solution of a. at least one lead salt of an organic acid of from 1 to 5 carbon atoms and b. at least one chloride, bromide, nitrate or different salt of organic acid of 1 to 5 carbon atoms of at least one metal of the group consisting of lead thallium and mercury.

* * * * *

UNITED STATES PATENT AND TRADEMARK OFFICE

CERTIFICATE OF CORRECTION

PATENT NO. : 3,937,970

DATED : February 10, 1976

INVENTOR(S) : Theodore F. Bolles and Peter B. Fleming

It is certified that error appears in the above-identified patent and that said Letters Patent are hereby corrected as shown below:

Cover page, [73], "Theodore F. Bolles; Peter B. Fleming, both of St. Paul, Minn." should read -- Minnesota Mining and Manufacturing Company, St. Paul, Minn. -- .

Column 1, Amendment under Rule 312 received before Base Issue Fee was not entered.

Column 1, line 15, "095" should be deleted.

Column 2, line 50, "$C_nH_{2n-1}$" should read -- $C_nH_{2n+1}$ -- .

Column 1, after title, insert -- This application is a continuation-in-part of our copending application Serial No. 289,582, filed September 15, 1972, now abandoned. --

Signed and Sealed this

Fifth Day of December 1978

[SEAL]

Attest:

RUTH C. MASON
Attesting Officer

DONALD W. BANNER
Commissioner of Patents and Trademarks